US008286384B2

(12) United States Patent
Zaderey et al.

(10) Patent No.: US 8,286,384 B2
(45) Date of Patent: Oct. 16, 2012

(54) BALLISTIC RANGE COMPENSATION FOR PROJECTILE WEAPON AIMING BASED ON AMMUNITION CLASSIFICATION

(75) Inventors: Serge Zaderey, Beaverton, OR (US); Steven R. Timm, Milwaukie, OR (US); Gary R. Williams, West Linn, OR (US); Victoria J. Peters, Vernonia, OR (US); Laura Peter, Whites Creek, TN (US); Tim Lesser, Forest Grove, OR (US); Tim L. O'Connor, Portland, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 12/163,333

(22) Filed: Jun. 27, 2008

(65) Prior Publication Data

US 2009/0199702 A1 Aug. 13, 2009

Related U.S. Application Data

(62) Division of application No. 10/933,856, filed on Sep. 3, 2004, now Pat. No. 7,603,804.

(60) Provisional application No. 60/518,377, filed on Nov. 4, 2003.

(51) Int. Cl.
*F41G 1/38* (2006.01)

(52) U.S. Cl. ..... 42/122; 89/41.17

(58) Field of Classification Search ..... 42/122; 89/41.17

See application file for complete search history.

(56) References Cited

U.S. PATENT DOCUMENTS

| | | | |
|---|---|---|---|
| 1,190,121 | A | 7/1916 | Critchett |
| 1,406,620 | A | 2/1922 | Dear |
| 2,171,571 | A | 9/1939 | Karnes |
| 2,464,521 | A | 3/1949 | McCall |
| 3,058,391 | A | 10/1962 | Leupold |
| 3,190,003 | A | 6/1965 | O'Brien |

(Continued)

FOREIGN PATENT DOCUMENTS

DE 199 49 800 A1 4/2001

(Continued)

OTHER PUBLICATIONS

Kahles GmbH, TDS Tri-Factor Reticle System, www.kahlesoptik.com/products/tds reticle.html, visited Oct. 15, 2003, 2 pages.

(Continued)

*Primary Examiner* — Michelle Clement
(74) *Attorney, Agent, or Firm* — Stoel Rives LLP

(57) ABSTRACT

A method for aiming a projectile weapon may utilize an aiming device having a primary aiming mark adapted to be sighted-in at a first selected range and one or more secondary aiming marks spaced below the primary aiming mark, and includes identifying, from at least two different groups of projectiles, a projectile group corresponding to a selected projectile. An aiming adjustment for the projectile weapon is determined and effected based on the range to the target and the nominal ballistic characteristics of the identified projectile group corresponding to the selected projectile. Other methods of aiming include identifying one projectile group from two or more predetermined projectile groups based on a selected projectile. Each predetermined projectile group preferably includes two or more different projectiles, preferably of different calibers, and a projectile having ballistic characteristics that are approximately median for each such projectile group.

30 Claims, 7 Drawing Sheets

| Cartridge | Gr | Vel | Selected power | 50Yrd | Inches error | MOA | % of nom | Approx Best Power | 400yrd | Inches error | MOA | % of nom | Approx Best Power | 500yrd | Inches error | MOA | % of nom | Approx Best Power |
|---|---|---|---|---|---|---|---|---|---|---|---|---|---|---|---|---|---|---|
| 223 REM | 55 | 2900 | 7.5 | -8.6 | -1.00 | -3.08 | 139.5% | 7.2 | -29.6 | -4.46 | -6.42 | 147.2% | 6.8 | -64.4 | -13.23 | -20.50 | 157.3% | 6.4 |
| 308 WIN | 150 | 2700 | 7.5 | -9.4 | -0.80 | -2.99 | 136.8% | 7.3 | -28 | -3.96 | -6.91 | 139.2% | 7.2 | -67.9 | -6.78 | -15.43 | 141.4% | 7.1 |
| 30-06 SPF | 180 | 2600 | 7.5 | -9.5 | -0.90 | -3.02 | 138.1% | 7.2 | -27.6 | -2.36 | -6.75 | 138.7% | 7.3 | -65.9 | -4.73 | -17.78 | 136.5% | 7.3 |
| 223 REM | 55 | 3000 | 7.5 | -8.8 | -0.20 | -2.80 | 127.9% | 7.6 | -27.3 | -2.16 | -6.69 | 135.5% | 7.4 | -59.5 | -8.13 | -18.88 | 144.8% | 6.8 |
| 30-06 SPF | 150 | 2800 | 7.5 | -8.7 | -0.10 | -2.77 | 126.5% | 7.5 | -25.7 | -0.56 | -6.18 | 127.9% | 7.8 | -53.2 | -2.03 | -16.93 | 129.9% | 7.7 |
| 30-06 SPF | 180 | 2700 | 7.5 | -8.7 | -0.10 | -2.77 | 126.5% | 7.5 | -25.3 | -0.16 | -6.05 | 125.5% | 7.9 | -51.3 | -0.13 | -16.33 | 125.3% | 8.0 |
| 223 REM | 55 | 3100 | 7.5 | -8.1 | 0.50 | -2.58 | 117.7% | 8.5 | -25.2 | -0.06 | -6.00 | 125.3% | 8.0 | -54.7 | 3.53 | -17.41 | 132.6% | 7.5 |
| 7MM MAG | 175 | 2700 | 7.5 | -8.5 | 0.10 | -2.71 | 123.6% | 8.1 | -24.5 | 0.94 | -7.60 | 121.2% | 8.2 | -49.4 | 1.78 | -15.72 | 120.7% | 8.3 |
| 30-06 SPF | 165 | 2800 | 7.5 | -8.2 | 0.40 | -2.61 | 119.2% | 8.4 | -24.1 | 1.04 | -7.67 | 119.8% | 8.3 | -49.4 | 1.78 | -15.72 | 120.7% | 8.3 |
| 243 WIN | 100 | 2800 | 7.5 | -8.1 | 0.50 | -2.58 | 117.7% | 8.5 | -23.7 | 1.44 | -7.54 | 117.9% | 8.5 | -48.3 | 2.88 | -15.37 | 118.0% | 8.5 |
| 30-06 SPF | 150 | 2900 | 7.5 | -8 | 0.60 | -2.55 | 116.3% | 8.6 | -23.7 | 1.44 | -7.54 | 117.9% | 8.5 | -49 | 2.18 | -15.60 | 119.7% | 8.4 |
| 30-06 SPF | 180 | 2900 | 7.5 | -8 | 0.60 | -2.55 | 116.3% | 8.6 | -23.2 | 1.94 | -7.38 | 115.4% | 8.7 | -47.2 | 3.97 | -15.02 | 115.3% | 8.7 |
| 270 WIN | 130 | 2850 | 7.5 | -7.8 | 0.80 | -2.48 | 113.4% | 8.8 | -22.5 | 2.64 | -7.16 | 111.9% | 8.9 | -45.5 | 5.68 | -14.48 | 111.1% | 9.0 |
| 7MM MAG | 175 | 2800 | 7.5 | -7.8 | 0.80 | -2.48 | 113.4% | 8.8 | -22.5 | 2.64 | -7.16 | 111.9% | 8.9 | -45.5 | 5.68 | -14.48 | 111.1% | 9.0 |
| .300 Win Short Mag | 200 | 3200 | 10.0 | -7.7 | -0.52 | -2.45 | 111.9% | 8.9 | -22.27 | -2.16 | -7.09 | 110.7% | 9.0 | -44.85 | -3.91 | -14.28 | 109.6% | 9.1 |
| 243 WIN | 100 | 3300 | 10.0 | -7.6 | -0.62 | -2.39 | 109.0% | 9.2 | -21.8 | -1.69 | -6.94 | 108.4% | 9.2 | -44.5 | -3.56 | -14.16 | 108.7% | 9.2 |
| 222 REM | 50 | 3300 | 10.0 | -7 | -0.12 | -2.23 | 101.7% | 9.8 | -21.7 | -1.59 | -6.91 | 107.9% | 9.3 | -47 | -6.06 | -14.96 | 114.8% | 8.7 |
| 7MM MAG | 150 | 3300 | 10.0 | -7.2 | -0.42 | -2.32 | 106.1% | 9.4 | -21.3 | -1.19 | -6.78 | 105.9% | 9.4 | -48.2 | -7.26 | -15.35 | 118.5% | 8.5 |
| 270 WIN | 150 | 3200 | 10.0 | -7.2 | -0.32 | -2.29 | 104.7% | 9.6 | -20.8 | -0.69 | -6.62 | 103.4% | 9.7 | -42 | -1.06 | -13.37 | 102.6% | 9.7 |
| 270 WIN | 130 | 3250 | 10.0 | -6.9 | -0.02 | -2.20 | 100.3% | 10.0 | -20.1 | 0.01 | -6.40 | 100.0% | 10.0 | -41 | -0.06 | -13.05 | 100.1% | 10.0 |
| 7MM MAG | 150 | 3250 | 10.0 | -6.8 | 0.08 | -2.16 | 98.8% | 10.1 | -19.7 | 0.41 | -6.27 | 98.0% | 10.2 | -40 | 0.94 | -12.73 | 97.7% | 10.2 |
| .338-.378 Weath | 250 | 3000 | 10.0 | -6.7 | 0.18 | -2.13 | 97.4% | 10.3 | -19.6 | 0.51 | -6.24 | 97.5% | 10.3 | -39.6 | 1.34 | -12.51 | 96.7% | 10.3 |
| 300 WIN | 150 | 3200 | 10.0 | -6.3 | 0.58 | -2.01 | 91.6% | 10.9 | -18.8 | 1.31 | -5.98 | 93.5% | 10.7 | -39 | 1.94 | -12.41 | 95.3% | 10.5 |
| 22-250 REM | 55 | 3500 | 10.0 | -6.1 | 0.78 | -1.94 | 88.7% | 11.3 | -18.6 | 1.51 | -5.90 | 92.5% | 10.7 | -40.8 | 0.14 | -12.99 | 99.7% | 10.0 |
| 270 WIN | 130 | 3100 | 10.0 | -6.4 | 0.48 | -2.04 | 93.0% | 10.7 | -18.7 | 1.41 | -5.95 | 93.0% | 10.8 | -39 | 2.94 | -12.10 | 92.8% | 10.8 |
| 25-06 REM | 100 | 3200 | 10.0 | -6.2 | 0.68 | -1.97 | 90.1% | 11.1 | -18.4 | 1.71 | -5.86 | 91.5% | 10.9 | -37.8 | 3.14 | -12.03 | 92.3% | 10.8 |
| 7MM MAG | 150 | 3100 | 10.0 | -6.3 | 0.58 | -2.01 | 91.6% | 10.9 | -18.3 | 1.81 | -5.83 | 91.0% | 11.0 | -37.1 | 3.84 | -11.81 | 90.6% | 11.0 |
| .270 Weath Speer GS | 150 | 3200 | 10.0 | -6.1 | 0.78 | -1.94 | 88.7% | 11.3 | -17.98 | 2.13 | -5.72 | 89.4% | 11.2 | -36.68 | 4.08 | -11.73 | 90.0% | 11.1 |
| .308 Ultra Mag | 225 | 3100 | 10.0 | -6.17 | 0.71 | -1.96 | 89.7% | 11.2 | -17.98 | 2.15 | -5.72 | 89.3% | 11.2 | -36.35 | 4.59 | -11.57 | 88.8% | 11.3 |
| 300 Win Short Mag | 150 | 3250 | 10.0 | -6.01 | 0.87 | -1.91 | 87.4% | 11.4 | -17.71 | 2.4 | -5.64 | 88.1% | 11.4 | -36.35 | 4.59 | -11.54 | 88.9% | 11.3 |
| 22-250 REM | 55 | 3600 | 10.0 | -5.7 | 1.18 | -1.81 | 82.8% | 12.1 | -17.6 | 2.51 | -5.60 | 87.5% | 11.4 | -38.1 | 2.84 | -12.13 | 93.1% | 10.7 |
| 270 WIN | 130 | 3200 | 10.0 | -5.9 | 0.98 | -1.88 | 85.8% | 11.7 | -17.4 | 2.71 | -5.54 | 86.5% | 11.6 | -35.4 | 5.54 | -11.27 | 86.9% | 11.6 |
| 300 Win Short Mag | 180 | 3200 | 10.0 | -5.55 | 1.33 | -1.77 | 80.7% | 12.4 | -16.1 | 4.01 | -5.12 | 80.1% | 12.5 | -32.35 | 8.55 | -10.31 | 79.1% | 12.6 |
| 270 Weath | 130 | 3350 | 10.0 | -5.1 | 1.78 | -1.62 | 74.1% | 13.5 | -14.32 | 5.19 | -4.75 | 74.2% | 13.5 | -30.28 | 10.68 | -9.65 | 73.9% | 13.5 |
| 300 Ultra Mag | 150 | 3600 | 10.0 | -4.83 | 2.05 | -1.54 | 70.2% | 14.2 | -14.32 | 5.75 | -4.56 | 71.2% | 14.0 | -29.38 | 11.58 | -9.35 | 71.7% | 13.9 |
| .300 UM sight in at 300 (300yd column ratio uses abt) | | | | | | | | | | | | | | | | | | |
| 270 WIN Rem SP (Rem design) | 130 | 3000 | 10.0 | -7.67 | -0.98 | -2.51 | 114.4% | 8.7 | -21.31 | -1.2 | -6.78 | 106.0% | 9.4 | -41.44 | -0.5 | -13.19 | 101.2% | 9.9 |
| | 130 | 3000 | 10.0 | -8.68 | 0 | -2.18 | 100.0% | 10.0 | -20.11 | 0 | -6.40 | 100.0% | 10.0 | -40.94 | 0 | -13.05 | 100.0% | 10.0 |
| At low setting: Subtensions increased by | 25 % | | | -8.60 | | -2.74 | | | -25.14 | | -8.00 | | | -51.18 | | -16.29 | | |

330

340

U.S. PATENT DOCUMENTS 3,297,389 A 1/1967 Gibson
3,313,026 A 4/1967 Akin, Jr.
3,381,380 A 5/1968 Thomas
3,392,450 A 7/1968 Herter et al.
3,431,652 A 3/1969 Leatherwood
3,464,770 A 9/1969 Schmidt
3,470,616 A 10/1969 Thompson
3,492,733 A 2/1970 Leatherwood
3,540,256 A 11/1970 Thompson
3,563,151 A 2/1971 Koeber
3,584,559 A 6/1971 Levin
3,639,997 A 2/1972 Koeber
3,644,043 A 2/1972 Jones et al.
3,679,307 A 7/1972 Zoot et al.
3,684,376 A * 8/1972 Lessard ..... 356/21
3,688,408 A 9/1972 Smith et al.
3,690,767 A 9/1972 Missio et al.
3,737,232 A 6/1973 Milburn, Jr.
3,749,494 A 7/1973 Hodges
3,754,828 A 8/1973 Darvasi
3,781,111 A 12/1973 Fletcher et al.
3,782,822 A * 1/1974 Spence ..... 356/21
3,797,909 A 3/1974 Hadzimahalis
3,826,012 A 7/1974 Pachmayr
3,839,725 A 10/1974 Koppensteiner
3,845,276 A 10/1974 Kendy et al.
3,847,474 A 11/1974 Uterhart
3,895,871 A 7/1975 Strasser
3,897,150 A 7/1975 Bridges et al.
3,899,251 A 8/1975 Frenk et al.
3,948,587 A * 4/1976 Rubbert ..... 356/21
3,982,246 A 9/1976 Lubar
3,990,155 A 11/1976 Akin, Jr. et al.
3,992,615 A 11/1976 Bennett et al.
4,025,193 A 5/1977 Pond et al.
4,136,394 A 1/1979 Jones et al.
4,173,402 A 11/1979 Horike et al.
4,195,425 A 4/1980 Leitz et al.
4,263,719 A 4/1981 Murdoch
4,266,463 A 5/1981 Saltin
4,268,167 A 5/1981 Alderman
4,285,137 A 8/1981 Jennie
4,305,657 A 12/1981 Masunaga et al.
4,321,683 A 3/1982 Goring et al.
4,325,190 A 4/1982 Duerst
4,329,033 A 5/1982 Masunaga et al.
4,355,904 A 10/1982 Balasubramanian
4,389,791 A 6/1983 Ackerman
4,403,421 A 9/1983 Shepherd
4,457,621 A 7/1984 Harris et al.
4,531,052 A 7/1985 Moore
4,561,204 A 12/1985 Binion
4,584,776 A 4/1986 Shepherd
4,593,967 A 6/1986 Haugen
4,617,741 A 10/1986 Bordeaux et al.
4,618,221 A 10/1986 Thomas
4,665,795 A 5/1987 Carbonneau et al.
4,681,433 A 7/1987 Aeschlimann
4,760,770 A 8/1988 Bagnall-Wild et al.
4,777,352 A 10/1988 Moore
4,787,739 A 11/1988 Gregory
4,806,007 A 2/1989 Bindon
4,834,531 A 5/1989 Ward
D306,173 S 2/1990 Reese
4,949,089 A 8/1990 Ruszkowski, Jr.
4,957,357 A 9/1990 Barns et al.
4,965,439 A 10/1990 Moore
4,988,189 A 1/1991 Kroupa et al.
4,993,833 A 2/1991 Lorey et al.
5,022,751 A 6/1991 Howard
5,026,158 A 6/1991 Golubic
5,082,362 A 1/1992 Schneiter
5,181,323 A * 1/1993 Cooper ..... 42/122
5,216,815 A 6/1993 Bessacini
5,233,357 A 8/1993 Ingensand et al.
5,241,360 A 8/1993 Key et al.
5,262,838 A 11/1993 Tocher
5,291,262 A 3/1994 Dunne
5,294,110 A 3/1994 Jenkins et al.
5,311,271 A 5/1994 Hurt et al.
5,313,409 A 5/1994 Wiklund et al.
5,359,404 A 10/1994 Dunne
5,374,985 A 12/1994 Beadles et al.
5,374,986 A 12/1994 Solinsky
5,375,072 A 12/1994 Cohen
5,479,712 A 1/1996 Hargrove et al.
5,483,336 A 1/1996 Tocher
5,519,642 A 5/1996 Kishimoto
5,539,513 A 7/1996 Dunne
5,568,152 A 10/1996 Janky et al.
5,586,063 A 12/1996 Hardin et al.
5,589,928 A 12/1996 Babbitt et al.
5,616,903 A 4/1997 Springer
5,634,278 A 6/1997 London
5,638,163 A 6/1997 Nourrcier, Jr.
5,650,949 A 7/1997 Kishimoto
5,669,174 A 9/1997 Teetzel
5,677,760 A 10/1997 Mikami et al.
5,686,690 A 11/1997 Lougheed et al.
5,691,808 A 11/1997 Nourrcier, Jr. et al.
5,751,406 A 5/1998 Nakazawa et al.
5,771,623 A 6/1998 Pernstich et al.
D397,704 S 9/1998 Reese
5,806,020 A 9/1998 Zykan
5,812,893 A 9/1998 Hikita et al.
5,824,942 A 10/1998 Mladjan et al.
D403,686 S 1/1999 Reese
5,914,775 A 6/1999 Hargrove et al.
5,920,995 A 7/1999 Sammut
5,933,224 A 8/1999 Hines et al.
5,940,171 A 8/1999 Tocher
6,023,322 A 2/2000 Bamberger
6,032,374 A 3/2000 Sammut
6,034,764 A 3/2000 Carter
6,073,352 A 6/2000 Zykan et al.
6,131,294 A 10/2000 Jibiki
6,252,706 B1 6/2001 Kaladgew
6,269,581 B1 8/2001 Groh
6,357,158 B1 3/2002 Smith, III
D456,057 S 4/2002 Smith, III
6,407,817 B1 6/2002 Norita et al.
6,453,595 B1 9/2002 Sammut
6,508,026 B1 * 1/2003 Uppiano et al. ..... 42/119
6,516,551 B2 2/2003 Gaber
6,516,699 B2 * 2/2003 Sammut et al. ..... 89/41.17
D475,758 S 6/2003 Ishikawa
6,574,900 B1 6/2003 Malley
6,583,862 B1 6/2003 Perger
6,591,537 B2 7/2003 Smith
6,634,112 B2 10/2003 Carr et al.
6,681,512 B2 * 1/2004 Sammut ..... 42/122
6,729,062 B2 * 5/2004 Thomas et al. ..... 42/122
6,772,550 B1 * 8/2004 Leatherwood ..... 42/119
6,873,406 B1 3/2005 Hines et al.
6,886,287 B1 5/2005 Bell et al.
D506,520 S 6/2005 Timm et al.
D517,153 S 3/2006 Timm et al.
7,100,320 B2 9/2006 Verdugo
7,118,498 B2 10/2006 Meadows et al.
D536,762 S 2/2007 Timm et al.
7,185,455 B2 * 3/2007 Zaderey ..... 42/122
7,239,377 B2 7/2007 Vermillion et al.
7,325,353 B2 * 2/2008 Cole et al. ..... 42/119
7,434,345 B2 10/2008 Verdugo
7,603,804 B2 10/2009 Zaderey et al.
7,654,029 B2 2/2010 Peters et al.
7,658,031 B2 2/2010 Cross et al.
7,690,145 B2 4/2010 Peters et al.
7,703,679 B1 4/2010 Bennetts et al.
8,046,951 B2 11/2011 Peters et al.
2002/0107768 A1 8/2002 Davis et al.
2002/0124452 A1 * 9/2002 Sammut ..... 42/122
2002/0129535 A1 * 9/2002 Osborn, II ..... 42/122
2002/0139030 A1 * 10/2002 Smith ..... 42/122
2003/0010190 A1 * 1/2003 Sammut et al. ..... 89/41.17
2003/0145719 A1 8/2003 Friedli et al.
2004/0016168 A1 1/2004 Thomas et al.

| | | | | |
|---|---|---|---|---|
| 2004/0020099 | A1* | 2/2004 | Osborn, II | 42/122 |
| 2005/0005495 | A1 | 1/2005 | Smith | |
| 2005/0021282 | A1* | 1/2005 | Sammut et al. | 702/150 |
| 2005/0046706 | A1 | 3/2005 | Sesek et al. | |
| 2005/0091903 | A1* | 5/2005 | Smith, III | 42/122 |
| 2005/0198885 | A1 | 9/2005 | Staley | |
| 2005/0219690 | A1 | 10/2005 | Lin et al. | |
| 2005/0221905 | A1 | 10/2005 | Dunne et al. | |
| 2005/0229468 | A1* | 10/2005 | Zaderey et al. | 42/122 |
| 2005/0246910 | A1 | 11/2005 | Mowers | |
| 2005/0252064 | A1 | 11/2005 | Williamson, IV et al. | |
| 2005/0257414 | A1* | 11/2005 | Zaderey et al. | 42/122 |
| 2005/0268521 | A1 | 12/2005 | Cox et al. | |
| 2006/0010760 | A1 | 1/2006 | Perkins et al. | |
| 2006/0010762 | A1 | 1/2006 | Lin et al. | |
| 2006/0077375 | A1 | 4/2006 | Vermillion et al. | |
| 2006/0225335 | A1 | 10/2006 | Florence et al. | |
| 2007/0044364 | A1* | 3/2007 | Sammut et al. | 42/122 |
| 2007/0068018 | A1 | 3/2007 | Gilmore | |
| 2007/0097351 | A1 | 5/2007 | York et al. | |
| 2007/0137088 | A1 | 6/2007 | Peters et al. | |
| 2007/0137090 | A1 | 6/2007 | Conescu | |
| 2007/0137091 | A1 | 6/2007 | Cross et al. | |
| 2008/0010891 | A1* | 1/2008 | Cole | 42/130 |
| 2008/0098640 | A1* | 5/2008 | Sammut et al. | 42/122 |
| 2008/0248449 | A1* | 10/2008 | Sammut | 434/23 |
| 2009/0199702 | A1 | 8/2009 | Zaderey et al. | |

FOREIGN PATENT DOCUMENTS

| | | | |
|---|---|---|---|
| GB | 2 225 844 | A | 6/1990 |
| JP | 10300840 | A | 11/1998 |
| JP | 2000356500 | A | 12/2000 |
| JP | 2001021291 | A | 1/2001 |
| TW | 383362 | B | 3/2000 |
| WO | WO 93/20399 | | 10/1993 |
| WO | WO 2005/015285 | A2 | 2/2005 |

OTHER PUBLICATIONS

Kahles GmbH, TDS Tri-Factor Reticle System Step 1, www.kahlesoptik.com/products/stepl.html, visited Oct. 15, 2003, 2 pages.
Kahles GmbH, TDS Tri-Factor Reticle System Step 2, www.kahlesoptik.com/products/step2.html, visited Oct. 15, 2003, 2 pages.
Kahles GmbH, TDS Tri-Factor Reticle System Step 3, www.kahlesoptik.com/products/step3.html, visited Oct. 15, 2003, 2 pages.
Kahles GmbH, TDS Tri-Factor Reticle System Step 4, www.kahlesoptik.com/products/step4.html, visited Oct. 15, 2003, 2 pages.
Kahles GmbH, TDS Tri-Factor Reticle System Decals, www.kahlesoptik.com/products/decals.html, visited Oct. 20, 2003, 3 pages.
Kahles GmbH, Bullet Sight-In and TDS Factor Chart Selection Reference Table, www.kahlesoptik.com/products/table.html, visited Oct. 15, 2003, 5 pages.
Swarovski Optik, TDS Tri-Factor Reticle System, "An Introduction and Familiarization on How Col. T.D. Smith's Shooting System Works," www.sportingrifles.com/tds_tri.htm, visited Oct. 16, 2003, 5 pages.
Leupold & Stevens Inc., Leupold 2003 Catalog, Nov. 2002, pp. 8, 9, 25 and 30.
Bray, Dr. Derek, "ISEMD Course External Ballistics Trajectory Modelling," Cranfield University, http:/www.rmcs.cranfield.ac.uk/aeroxtra/isemdtrajmod.ppt, visited Oct. 6, 2003, 23 pages.
Intelligration Systems Group, "What is Ballistic coefficient and How Is It Calculated," Topic of the Month: Sep. 2001, www.loadammo.com/Topics/September01.htm, 3 pages.
Bercovitz, John, "Hatcher's Notebook—errata," www.yarchive.net/gun/hatchers_notebook.html, visited Nov. 1, 2003, 3 pages.
Ingalls Tables Historical Summary, www.51phantom.com/ebexplained/4th/30.cfmtingalls+tables&hl=en&ie=utf-8, visited Nov. 1, 2003, 4 pages.
Schmidt & Bender GmbH, "Rifle Scopes Built for the Demanding Needs of the Precision Sharpshooter," (date unknown), 3 pages.
Shepherd Scope Ltd., Shepherd's Easy One Shot Zero, product brochure, (date unknown), 2 pages.
Swarovski Optik, advertisement for "Christmas Tree Reticle," (date unknown), 1 page.
Trijicon, Inc., Bindon Aiming Concept Reticles, (date unknown), 5 pages.
Nightforce Precision Optics, Illuminated Reticles, (date unknown), 1 page.
Elcan Optical Technologies, SpecterlR Thermal Weapon Sight, M240/M249 Machine Gun Reticle and M4 Carbene Reticle, (date unknown), 10 pages.
Burris Optics, Plex Reticle and Ballistic Mil-Dot Reticle, http://www.burrisoptics.com/reticles.html, (date unknown), 3 pages.
Carl Zeiss, Reticles, (date unknown), 2 pages.
Simmons Outdoor Corporation, 2003 Catalog, pp. 9 and 11.
Premier Reticles, Ltd., Introducing the Next Generation Mil-dot reticle-GEN 2 MIL-DOT, www.premierreticles.com/gen2.html, visited Nov. 21, 2002, 2 pages.
Premier Reticles. Ltd., Mil-dot User Guide, www.premierreticles.com/mildotgu.htm, visited Nov. 21, 2002, 14 pages.
Premier Reticles, Ltd., 2002 Pricing & Information/Catalog, Aug. 1, 2002, 21 pages.
German text on riflescopes: "Zusammenstellung Moglicher Zielfernrohr-Absehen," (date unknown), p. 477.
Redfield Optics, LE-9 Sniper Reticle, Jul. 19, 1994, 1 page.
D.O.D. Proprietary Data Drawing for Special Reticle for SSG86-10 Power Optic for Exclusive Use by Gun South, Inc., Jun. 30, 1986, 1 page.
U.S. Appl. No. 29/193,335, filed Nov. 4, 2003, 5 pages.
Leatherwood Optics, Automatic Ranging & Trajectory Scopes, 2001, 7 pages.
Leatherwood Optics, The Leatherwood Sporter, 1999, 16 pages.
Leatherwood Optics, Telescope/Auto-Ranging Art II Operation Manual, date unknown (at least as early as 2000), 11 pages.
Hi-Lux Optics, Instructions for the Hi-Lux Uni-Dial The First Programmable Range Dial, date unknown (at least as early as Sep. 2006), 4 pages.
Hi-Lux Optics, The New No-Math Mil-Dot Reticle, date unknown (at least as early as Sep. 2006), 2 pages.
Mike Brown, "The Rifleman's Rule—Revisited", May 2003, 9 pages.
Leica, Leica Vector Rangefinding Binoculars, http://www.leica.com/optronics/product/vector.html, archived Jun. 7, 1997.
McDonald, William T., "Inclined Fire," available at www.exteriorballistics.com/ebexplained/article1.html, Jun. 2003, 9 pp.
Sierra Bullets, "Infinity Exterior Ballistic Software," www.sierrabullets.com, visited Oct. 26, 2005, 2 pp.

* cited by examiner

FIG. 1
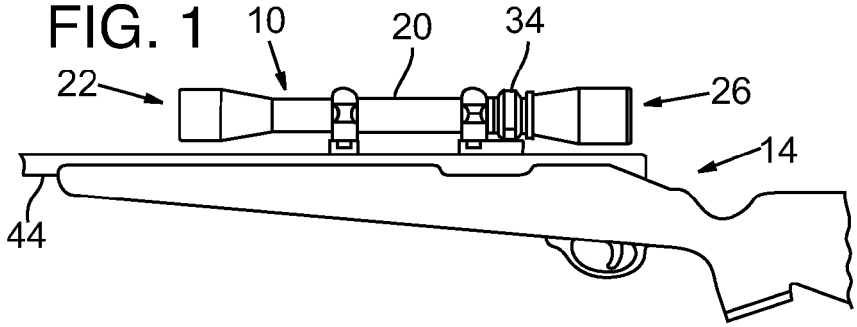
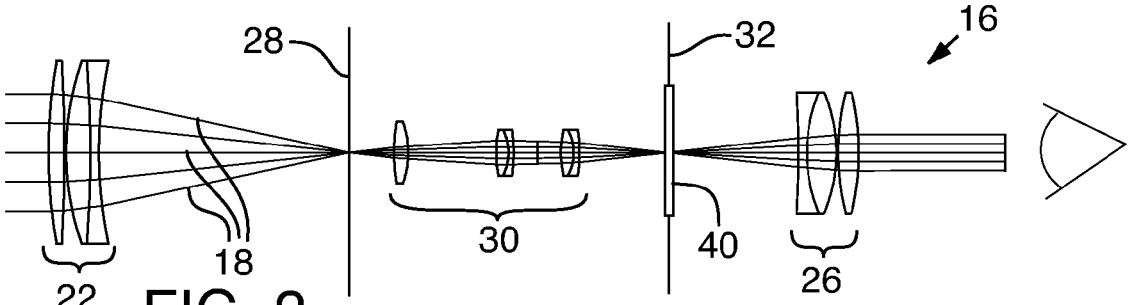
FIG. 2
FIG. 3
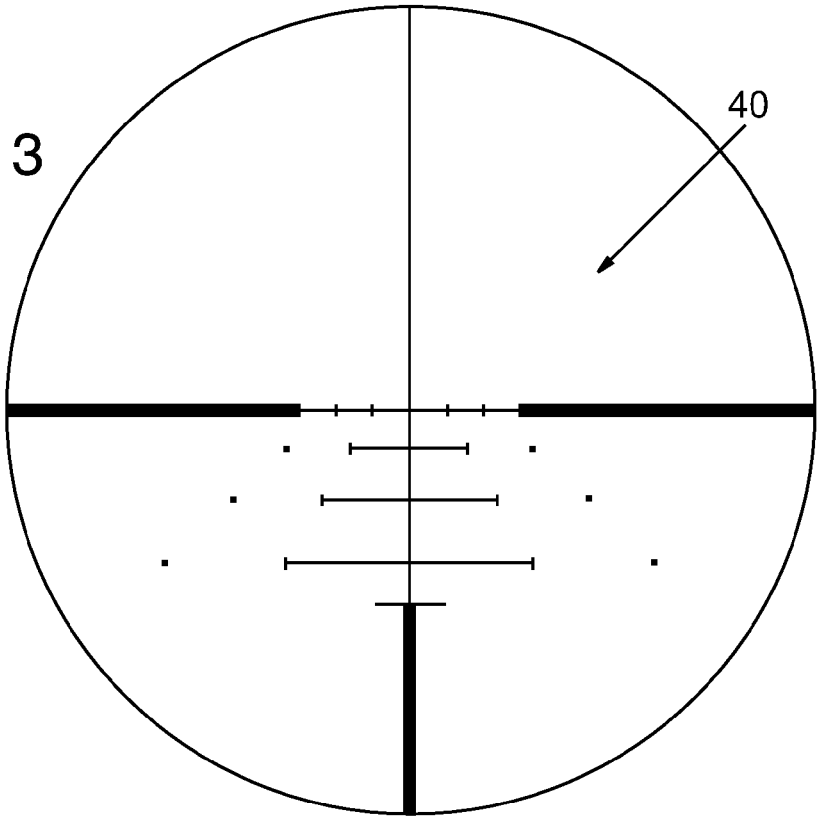

| Cartridge | Gr | Vel | Selected power | 300yrd | Inches error | MOA | % of nom | Approx Best Power | 400yrd | Inches error | MOA | % of nom | Approx Best Power | 500yrd | Inches error | MOA | % of nom | Approx Best Power |
|---|---|---|---|---|---|---|---|---|---|---|---|---|---|---|---|---|---|---|
| 223 REM | 55 | 2900 | 7.5 | -9.6 | -1.00 | -3.06 | 139.5% | 7.2 | -29.6 | -4.46 | -9.42 | 147.2% | 6.8 | -64.4 | -13.23 | -20.50 | 157.3% | 6.4 |
| 308 WIN | 150 | 2700 | 7.5 | -9.4 | -0.80 | -2.99 | 136.6% | 7.3 | -28 | -2.86 | -8.91 | 139.2% | 7.2 | -57.9 | -6.73 | -18.43 | 141.4% | 7.1 |
| 30-06 SPF | 180 | 2600 | 7.5 | -9.5 | -0.90 | -3.02 | 138.1% | 7.2 | -27.5 | -2.36 | -8.75 | 136.7% | 7.3 | -55.9 | -4.73 | -17.79 | 136.5% | 7.3 |
| 223 REM | 55 | 3000 | 7.5 | -8.8 | -0.20 | -2.80 | 127.9% | 7.8 | -27.3 | -2.16 | -8.69 | 135.8% | 7.4 | -59.3 | -8.13 | -18.88 | 144.8% | 6.9 |
| 30-06 SPF | 150 | 2800 | 7.5 | -8.7 | -0.10 | -2.77 | 126.5% | 7.9 | -25.7 | -0.56 | -8.18 | 127.8% | 7.8 | -53.2 | -2.03 | -16.93 | 129.9% | 7.7 |
| 30-06 SPF | 180 | 2700 | 7.5 | -8.7 | -0.10 | -2.77 | 126.5% | 7.9 | -25.3 | -0.16 | -8.05 | 125.8% | 7.9 | -51.3 | -0.13 | -16.33 | 125.3% | 8.0 |
| 223 REM | 55 | 3100 | 7.5 | -8.1 | 0.50 | -2.58 | 117.7% | 8.5 | -25.2 | -0.06 | -8.02 | 125.3% | 8.0 | -54.7 | -3.53 | -17.41 | 133.6% | 7.5 |
| 7MM MAG | 175 | 2700 | 7.5 | -8.5 | 0.10 | -2.71 | 123.5% | 8.1 | -24.5 | 0.64 | -7.80 | 121.8% | 8.2 | -49.4 | 1.78 | -15.72 | 120.7% | 8.3 |
| 30-06 SPF | 165 | 2800 | 7.5 | -8.2 | 0.40 | -2.61 | 119.2% | 8.4 | -24.1 | 1.04 | -7.67 | 119.8% | 8.3 | -49.4 | 1.78 | -15.72 | 120.7% | 8.3 |
| 243 WIN | 100 | 2800 | 7.5 | -8.1 | 0.50 | -2.58 | 117.7% | 8.5 | -23.7 | 1.44 | -7.54 | 117.9% | 8.5 | -48.3 | 2.88 | -15.37 | 118.0% | 8.5 |
| 30-06 SPF | 150 | 2900 | 7.5 | -8 | 0.60 | -2.55 | 116.3% | 8.6 | -23.7 | 1.44 | -7.54 | 117.9% | 8.5 | -49 | 2.18 | -15.60 | 119.7% | 8.4 |
| 30-06 SPF | 180 | 2800 | 7.5 | -8 | 0.60 | -2.55 | 116.3% | 8.6 | -23.2 | 1.94 | -7.38 | 115.4% | 8.7 | -47.2 | 3.97 | -15.02 | 115.3% | 8.7 |
| 270 WIN | 150 | 2800 | 7.5 | -7.8 | 0.80 | -2.48 | 113.4% | 8.8 | -22.5 | 2.64 | -7.16 | 111.9% | 8.9 | -45.5 | 5.68 | -14.48 | 111.1% | 9.0 |
| 7MM MAG | 175 | 2800 | 7.5 | -7.8 | 0.80 | -2.48 | 113.4% | 8.8 | -22.5 | 2.64 | -7.16 | 111.9% | 8.9 | -45.5 | 5.68 | -14.48 | 111.1% | 9.0 |
| .300 Win Short Mag | 200 | 3200 | 10.0 | -7.7 | -0.82 | -2.45 | 111.9% | 8.9 | -22.27 | -2.16 | -7.09 | 110.7% | 9.0 | -44.85 | -3.91 | -14.28 | 109.6% | 9.1 |
| 243 WIN | 100 | 2900 | 10.0 | -7.5 | -0.62 | -2.39 | 109.0% | 9.2 | -21.8 | -1.69 | -6.94 | 108.4% | 9.2 | -44.5 | -3.56 | -14.16 | 108.7% | 9.2 |
| 222 REM | 50 | 3300 | 10.0 | -7 | -0.12 | -2.23 | 101.7% | 9.8 | -21.7 | -1.59 | -6.91 | 107.9% | 9.3 | -47 | -6.06 | -14.96 | 114.8% | 8.7 |
| 7MM MAG | 150 | 2900 | 10.0 | -7.3 | -0.42 | -2.32 | 106.1% | 9.4 | -21.3 | -1.19 | -6.78 | 105.9% | 9.4 | -43.2 | -2.26 | -13.75 | 105.5% | 9.5 |
| 270 WIN | 150 | 2900 | 10.0 | -7.2 | -0.32 | -2.29 | 104.7% | 9.6 | -20.8 | -0.69 | -6.62 | 103.4% | 9.7 | -42 | -1.06 | -13.37 | 102.6% | 9.7 |
| 270 WIN | 130 | 3000 | 10.0 | -6.9 | -0.02 | -2.20 | 100.3% | 10.0 | -20.1 | 0.01 | -6.40 | 100.0% | 10.0 | -41 | -0.06 | -13.05 | 100.1% | 10.0 |
| 7MM MAG | 150 | 3000 | 10.0 | -6.8 | 0.08 | -2.16 | 98.8% | 10.1 | -19.7 | 0.41 | -6.27 | 98.0% | 10.2 | -40 | 0.94 | -12.73 | 97.7% | 10.2 |
| .338-.378 Weath | 250 | 3000 | 10.0 | -6.7 | 0.18 | -2.13 | 97.4% | 10.3 | -19.6 | 0.51 | -6.24 | 97.5% | 10.3 | -39.6 | 1.34 | -12.61 | 96.7% | 10.3 |
| 300 WIN | 150 | 3200 | 10.0 | -6.3 | 0.58 | -2.01 | 91.6% | 10.9 | -18.8 | 1.31 | -5.98 | 93.5% | 10.7 | -39 | 1.94 | -12.41 | 95.3% | 10.5 |
| 22-250 REM | 55 | 3500 | 10.0 | -6.1 | 0.78 | -1.94 | 88.7% | 11.3 | -18.8 | 1.31 | -5.98 | 93.5% | 10.7 | -40.8 | 0.14 | -12.99 | 99.7% | 10.0 |
| 270 WIN | 130 | 3100 | 10.0 | -6.4 | 0.48 | -2.04 | 93.0% | 10.7 | -18.7 | 1.41 | -5.95 | 93.0% | 10.8 | -38 | 2.94 | -12.10 | 92.8% | 10.8 |
| 25-06 REM | 100 | 3200 | 10.0 | -6.2 | 0.68 | -1.97 | 90.1% | 11.1 | -18.4 | 1.71 | -5.86 | 91.5% | 10.9 | -37.8 | 3.14 | -12.03 | 92.3% | 10.8 |
| 7MM MAG | 150 | 3100 | 10.0 | -6.3 | 0.58 | -2.01 | 91.6% | 10.9 | -18.3 | 1.81 | -5.83 | 91.0% | 11.0 | -37.1 | 3.84 | -11.81 | 90.6% | 11.0 |
| .270 Weath Speer GS | 150 | 3200 | 10.0 | -6.1 | 0.78 | -1.94 | 88.7% | 11.3 | -17.98 | 2.13 | -5.72 | 89.4% | 11.2 | -36.86 | 4.08 | -11.73 | 90.0% | 11.1 |
| .338 Ultra Mag | 225 | 3100 | 10.0 | -6.17 | 0.71 | -1.96 | 89.7% | 11.2 | -17.96 | 2.15 | -5.72 | 89.3% | 11.2 | -36.35 | 4.59 | -11.57 | 88.8% | 11.3 |
| .300 Win Short Mag | 150 | 3200 | 10.0 | -6.01 | 0.87 | -1.91 | 87.4% | 11.4 | -17.71 | 2.4 | -5.64 | 88.1% | 11.4 | -36.26 | 4.68 | -11.54 | 88.6% | 11.3 |
| 22-250 REM | 55 | 3600 | 10.0 | -5.7 | 1.18 | -1.81 | 82.8% | 12.1 | -17.6 | 2.51 | -5.60 | 87.5% | 11.4 | -38.1 | 2.84 | -12.13 | 93.1% | 10.7 |
| 270 WIN | 130 | 3200 | 10.0 | -5.9 | 0.98 | -1.88 | 85.8% | 11.7 | -17.4 | 2.71 | -5.54 | 86.5% | 11.6 | -35.4 | 5.54 | -11.27 | 86.5% | 11.6 |
| .300 Win Short Mag | 180 | 3200 | 10.0 | -5.55 | 1.33 | -1.77 | 80.7% | 12.4 | -16.1 | 4.01 | -5.12 | 80.1% | 12.5 | -32.39 | 8.55 | -10.31 | 79.1% | 12.6 |
| .270 Weath | 130 | 3360 | 10.0 | -5.1 | 1.78 | -1.62 | 74.1% | 13.5 | -14.92 | 5.19 | -4.75 | 74.2% | 13.5 | -30.26 | 10.68 | -9.63 | 73.9% | 13.5 |
| .300 Ultra Mag | 150 | 3500 | 10.0 | -4.83 | 2.05 | -1.54 | 70.2% | 14.2 | -14.32 | 5.79 | -4.56 | 71.2% | 14.0 | -29.36 | 11.58 | -9.35 | 71.7% | 13.9 |
| .300 UM sight in at 300 (300yd column =400 yards, etc) | | | 10.0 | -7.87 | -0.99 | -2.51 | 114.4% | 8.7 | -21.31 | -1.2 | -6.78 | 106.0% | 9.4 | -41.44 | -0.5 | -13.19 | 101.2% | 9.9 |
| .270 Win Hom SP (nom design) | 130 | 3000 | 10.0 | -6.88 | 0 | -2.19 | 100.0% | 10.0 | -20.11 | 0 | -6.40 | 100.0% | 10.0 | -40.94 | 0 | -13.03 | 100.0% | 10.0 |
| At low setting: Subtensions increased by | 25 % | | | -8.60 | | -2.74 | | | -25.14 | | -8.00 | | | -51.18 | | -16.29 | | |

320

310

330

340

FIG. 8

BALLISTIC RANGE COMPENSATION FOR PROJECTILE WEAPON AIMING BASED ON AMMUNITION CLASSIFICATION

RELATED APPLICATIONS

This application is a divisional application of U.S. patent application Ser. No. 10/933,856, filed Sep. 3, 2004, which claims the benefit of U.S. Provisional Patent Application No. 60/518,377, filed Nov. 4, 2003, both of which are incorporated herein by reference. This application is also related to U.S. design Pat. Nos. D506,520, D517,153, and D536,762 all titled "RETICLE FOR A GUNSIGHT OR OTHER PROJECTILE WEAPON AIMING DEVICE" and filed Nov. 4, 2003.

TECHNICAL FIELD

This application relates to projectile weapon aiming systems such as riflescopes, to reticle configurations for projectile weapon aiming systems, and to associated methods of compensating for ballistic characteristics.

BACKGROUND OF THE INVENTION

Projectile weapon aiming systems are discussed herein principally with reference to their use on rifles and embodied in telescopic sights commonly known as riflescopes. It will become apparent, however, that projectile weapon aiming systems may include aiming devices other than riflescopes, and may be used on weapons other than rifles, which are capable of propelling projectiles along substantially predeterminable trajectories, e.g., handguns, crossbows, and artillery.

A factor that must be taken into account in long-range shooting is the curved trajectory traversed by a bullet or other projectile as it falls from its initial trajectory while traveling the distance from the gun to the target, i.e., "range." An aiming line of sight emanating from a reticle aiming mark of a riflescope rigidly affixed to the gun is straight, and hence the line of sight can intersect the curved trajectory only at a discrete range. At other ranges the projectile will pass below or above the aiming line of sight, necessitating the use of elevation adjustments for aiming. Elevation adjustments in such riflescopes are typically made by turning an adjustment mechanism of the riflescope to impart vertical movement of optical elements (as described, for example, in U.S. Pat. No. 3,297,389 of Gibson) or of the reticle (as described, for example, in U.S. Pat. No. 3,058,391 of Leupold), so that the aiming line of sight is accurately "sighted-in" at the range of the target. To adjust for the effect of crosswinds, riflescopes also typically include a separate adjustment mechanism for imparting horizontal movement to the optical elements or reticle. In yet other projectile weapon aiming systems, the entire aiming device is adjusted relative to the weapon via an adjustable sight mount. Adjustment of the elevation and windage is time consuming and may require the shooter to take his or her eyes off the target while manipulating the adjustment mechanisms.

There have been proposed numerous reticles and riflescopes designed to provide the shooter with a plurality of aiming marks for shooting at targets at various predetermined ranges, i.e., aiming marks producing line of sight/trajectory intersections at various ranges. Some of these include devices for approximating the range to the target. These riflescopes propose to eliminate the need to make elevation adjustments in the riflescope to compensate for bullet drop at different ranges. Exemplary riflescopes are disclosed in U.S. Pat. Nos.

3,190,003 of O'Brien; 1,190,121 of Critchett; 3,392,450 of Herter et al.; 3,431,652 of Leatherwood; 3,492,733 of Leatherwood; 6,032,374 of Sammut; and 6,591,537 of Smith. Most of these patents propose riflescopes providing a plurality of range-related aiming marks accompanied with aiming mark selection devices, the use of which depends on relative height of the image of a target of known or estimable height compared to the height of a feature in the reticle.

Using modern laser rangefinders and other ranging techniques, it is now possible to quickly determine a range to target more accurately than by using one of the range-finding reticles described above.

U.S. Pat. No. 3,948,587 of Rubbert proposes a riflescope with a reticle that includes vertically adjacent target-spanning and aiming apertures dimensioned so that when a target of known or estimable size is framed in one of the apertures, the gun is thereby aimed for the correct range to the target. However, Rubbert does not provide an aiming mark or points of reference when the target is at a range such that it does not fit any of the apertures. The apparent spacing of the target-spanning and aiming apertures can be changed by varying the optical power of the riflescope; however, due to a limited amount of optical power adjustment available, the riflescope of Rubbert is useful only for aiming at targets within a limited size range. For example, Rubbert describes a riflescope that can be adjusted for use in aiming at targets sized between 14 and 40 inches in height. Attempting to fit smaller or larger targets in the apertures would result in gross aiming errors.

U.S. Pat. Nos. 6,032,374 of Sammut and 6,591,537 of Smith propose reticles having a series of secondary aiming marks spaced below a primary aiming mark at predetermined intervals for compensating for bullet drop. After determining or estimating an observed range, the shooter selects the secondary aiming mark most closely corresponding to the observed range. The secondary aiming marks of Sammut are evenly spaced, but a bullet's trajectory is parabolic, so Sammut requires preliminary collection of ballistic data to determine the range corresponding to each secondary aiming mark. The corresponding ranges determined by the collection of ballistic data are applicable only for the ballistics of particular ammunition for which data is collected. Furthermore, a shooter must either memorize the ranges that are empirically determined or refer to a worksheet where the ballistic data and corresponding ranges have been recorded.

Smith purports to provide secondary aiming marks for regular incremental ranges (typically 300, 400, 500, and 600 yards) in an attempt to eliminate the need, as with the device of Sammut, to refer to ballistics data or to memorize the ranges corresponding to the secondary aiming marks. However, the ranges of the secondary aiming marks of Smith are accurate only for a particular predetermined rifle and ammunition combination, referred to as the ballistic "factor." For ammunition having a ballistic factor different from the factor for which the reticle is designed, Smith proposes to apply a decal to the stock of the rifle or some other convenient location for reference in determining the irregular ranges at which the secondary aiming marks can be used to aim the rifle.

The present inventors have recognized a need for an improved projectile weapon aiming system for accurately compensating for ballistic drop and windage for a variety of ammunition having different ballistic characteristics.

SUMMARY OF THE INVENTION

In accordance with preferred embodiments, a method for aiming a projectile weapon aiming system that includes an aiming device having a primary aiming mark adapted to be sighted-in at a first selected range comprises identifying, from at least two different groups of projectiles, a projectile group corresponding to a selected projectile. Each of the different groups of projectiles encompasses two or more different types of projectiles having different calibers and each group has associated nominal ballistic characteristics.

In some embodiments, the projectile weapon is sighted-in at a first range so the primary aiming mark is superposed with a nominal point of impact of a projectile when shot from the projectile weapon at the first range. After sighting-in the projectile weapon, an aiming adjustment for the projectile weapon is determined and effected based on the range to the target and the nominal ballistic characteristics of the identified projectile group corresponding to the selected projectile.

In some embodiments, the method includes obtaining a list of multiple types of projectiles and associated predetermined projectile groups that each correspond to one of several predetermined ballistic compensation settings, and from such a list, identifying a ballistic compensation setting corresponding to a selected projectile.

Other methods of aiming include identifying one projectile group from two or more predetermined projectile groups based on a selected projectile. Each predetermined projectile group preferably includes two or more different projectiles, preferably of different calibers, and a projectile having ballistic characteristics that are approximately median for each such projectile group. The ballistic characteristics that are approximately median are preferably different for each predetermined projectile group.

Additional aspects and advantages of this invention will be apparent from the following detailed description of preferred embodiments, which proceeds with reference to the accompanying drawings.

BRIEF DESCRIPTION OF THE DRAWINGS

FIG. 1 is a side elevation view of a riflescope mounted on a rifle in accordance with a preferred embodiment;

FIG. 2 is a schematic diagram showing optical elements of a riflescope in accordance with a preferred embodiment;

FIG. 3 is a view of a reticle in accordance with a preferred embodiment as viewed through an ocular (eyepiece) of a riflescope;

FIG. 8 is a table listing ballistic drop data for a variety of ammunition at selected incremental ranges corresponding to secondary aiming marks of the reticle of FIG. 5; the ammunition is grouped into two groups corresponding to two different optical power settings of the riflescope of FIG. 7, which are selected to compensate for ballistic characteristics of the two groups of ammunition;

DETAILED DESCRIPTION OF PREFERRED EMBODIMENTS

Figure 4:
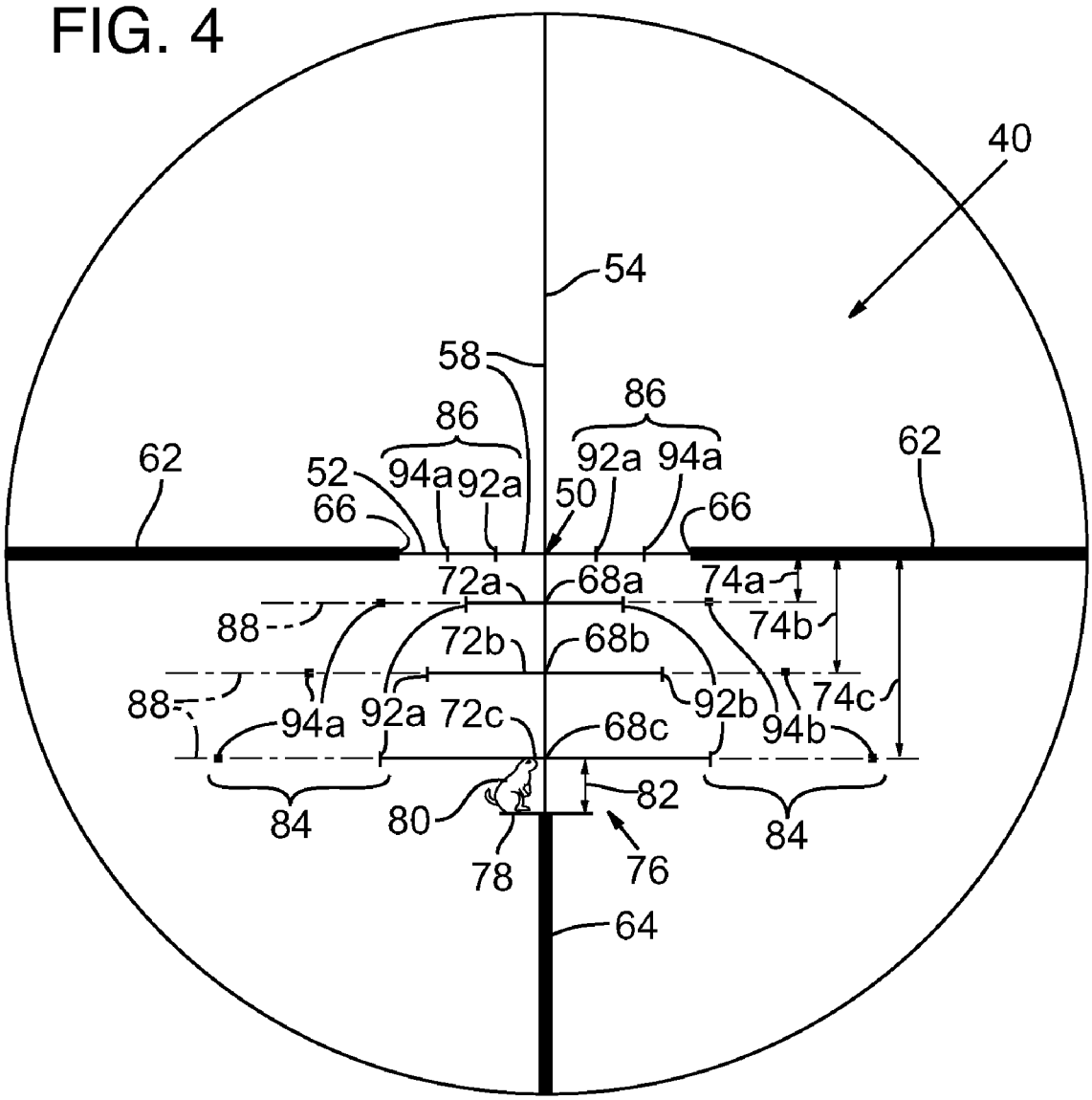
FIG. 4 is a view of the reticle of FIG. 3 including dimension lines and reference numerals referred to in the detailed description for describing the various features of the reticle.

Throughout the specification, reference to "one embodiment," "an embodiment," or "some embodiments" means that a particular described feature, structure, or characteristic is included in at least one embodiment. Thus appearances of the phrases "in one embodiment," "in an embodiment," or "in some embodiments" in various places throughout this specification are not necessarily all referring to the same embodiment. Furthermore, the described features, structures, or characteristics may be combined in any suitable manner in one or more embodiments.

Furthermore, the described features, structures, characteristics, and methods may be combined in any suitable manner in one or more embodiments. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

FIG. 1 is a side elevation view of a riflescope 10 mounted to a rifle 14 in accordance with a preferred embodiment. FIG. 2 is a schematic diagram showing an arrangement of optical elements 16 of riflescope 10, together with ray trace lines 18 indicating the path of light from an observed object (not shown) located to the left of the assembly of optical elements 16, as the light travels through the optical system along an optical path. With reference to FIGS. 1 and 2, riflescope 10 includes a tubular housing 20 that supports at opposite ends an objective or objective lens assembly 22 and an ocular or ocular lens assembly 26 (sometimes referred to as an eyepiece or eyepiece lens assembly). Objective 22 focuses the image of an observed object at a first (front) focal plane 28 located medially of objective 22 and ocular 26. A power-adjusting erector lens assembly 30 interposed between objective 22 and ocular 26 inverts the image and refocuses it at a second (rear) focal plane 32 between erector lens assembly 30 and ocular 26. A preferred riflescope 10 may comprise, for example, a VARI-X® III brand riflescope sold by Leupold & Stevens, Inc., Beaverton, Oreg., USA, modified according to various preferred embodiments to include a reticle 40 of the kind described below. At least a part of erector lens assembly 30 is movable in response to rotation of a power selector ring 34 or other power selector mechanism to adjust the optical power of riflescope 10 within a predetermined range of magnification. For example, the optical power of riflescope 10 may range between approximately 8.5× and 25× magnification, in accordance with a first preferred embodiment, or between approximately 6.5× and 20× magnification, in accordance with an alternative embodiment. Other embodiments may allow optical power adjustment within different ranges of adjustment, such as 4.5-14×, 3.5-10×, and 2.5-8×, for example, the optical zoom ratio in each instance being approximately 3:1. In yet other embodiments, the optical power of riflescope 10 may be fixed.

Reticle 40 is located in the optical path between objective 22 and ocular 26 and more preferably between erector lens assembly 30 and ocular 26, at or adjacent second focal plane 32. By way of example, reticle 40 may be used in a riflescope 10 in a configuration of certain riflescopes sold by Leupold & Stevens, Inc., Beaverton, Oreg., USA under the trademarks LPS®, VARI-X®, VX®, and others. However, the reticles described herein are not limited to use in riflescopes or with rifles, but may also be used in various other types of sighting devices and projectile weapon aiming devices and may be used to aim one or more of a variety of projectile weapons, such as rifles, pistols, crossbows, artillery, and others.

FIG. 3 is an enlarged pictorial representation of reticle 40 as viewed through ocular 26 of riflescope 10. FIG. 4 is another enlarged pictorial view of reticle 40, with reference numbers and dimension lines, as referred to below. Reticle 40 is preferably formed on a substantially flat disc of optical quality material, such as glass or plastic, and includes a primary aiming mark 50 (also referred to herein as the primary aiming point 50) formed by the intersection of a primary horizontal sight line 52 and a primary vertical sight line 54. While primary sight lines 52 and 54 and other indicia, described below, may be marked on the surface of a transparent reticle disc, they may also be embodied in other forms, such as reticle wires, iron sights, illuminated reticle devices, projected targeting displays, head-up displays, simulated reticle images, and the like. Thus, the terms "reticle", "mark", "marking", "marks", "lines", and the like are not limited to permanent inscriptions on a physical object, but are intended to also include all kinds of visually perceptible patterns, signs, and symbols, regardless of the way in which they are created and regardless of whether their elements are permanent or transitory in nature, or a combination of both permanent and transitory elements.

Figure 5:
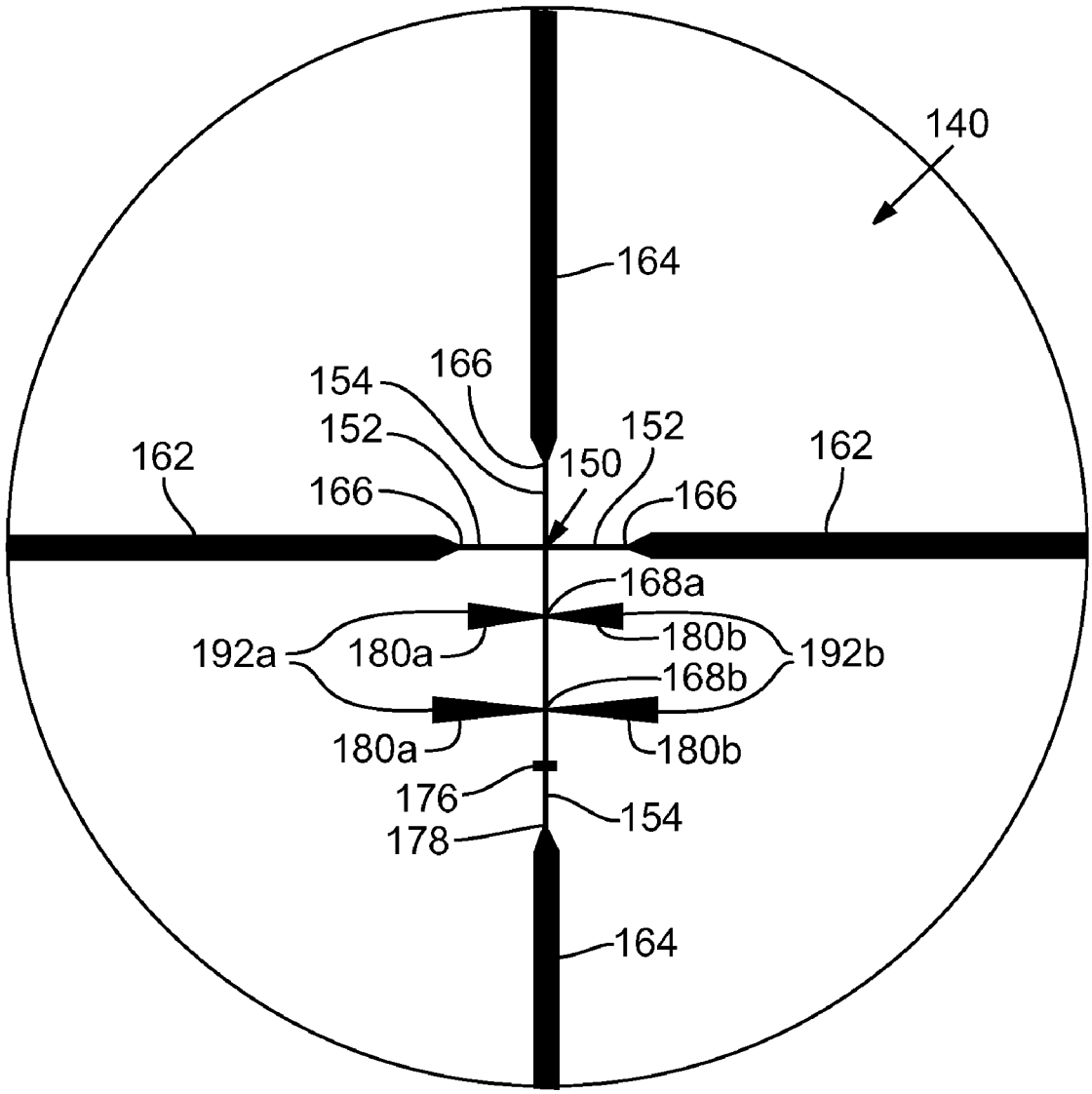
FIG. 5 is a view of a reticle in accordance with a second preferred embodiment, which is adapted for big game hunting.
Figure 6:
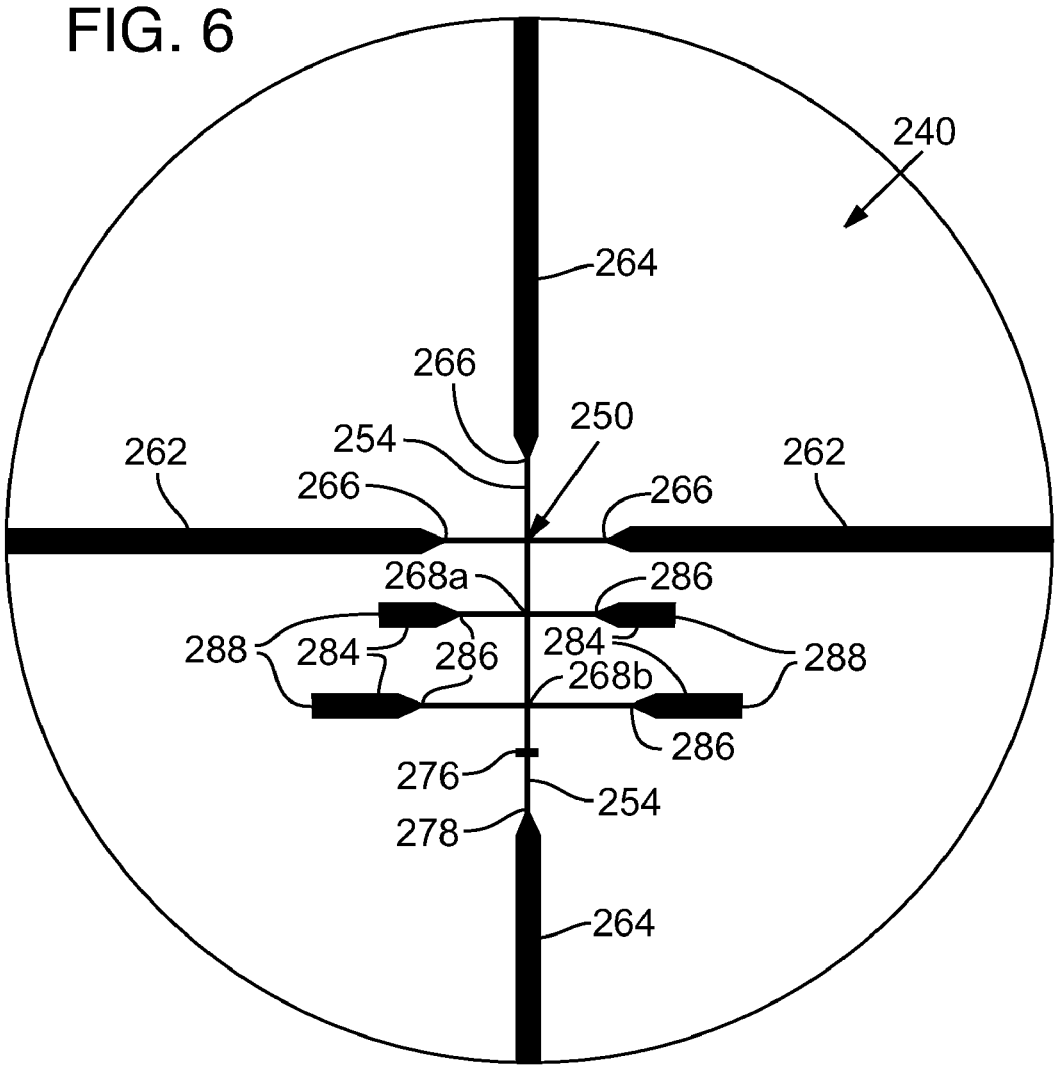
FIG. 6 is a view of a reticle in accordance with a third preferred embodiment, also adapted for big game hunting.

The arrangement and selection of the aiming marks of reticle 40 of FIG. 3 are particularly suited to varmint shooting, in which the targeted animals are relatively small, the optical power range of riflescope 10 is relatively high, and small fast ammunition is used. FIGS. 5 and 6 are enlarged pictorial views of second and third reticle embodiments 140 and 240, respectively, both designed for big game hunting. Big game reticles 140 and 240 may be substituted for reticle 40 in riflescope 10 (FIGS. 1 and 2). The aiming marks of big game reticles 140 and 240 are generally thicker than those of varmint reticle 40, affording better reticle visibility in low light conditions common to early morning hunts. And because big game animals are larger than varmints, they are less likely to be obscured by the larger marks and lines of big game reticles 140 and 240. In contrast, the aiming marks of varmint reticle 40 are made finer to afford greater target visibility and more accurate shot placement.

The thickness of fine central portions 58 of primary horizontal and vertical sight lines 52 and 54 (and secondary horizontal sight lines 72*a-c*, described below) may be sized, for example, to subtend an angle of approximately 0.13 minute of angle (MOA) in the field of view, wherein 1 MOA=1/60th degree. Primary horizontal and vertical sight lines 52 and 54 may include one or more widened post portions 62 and 64, respectively, located radially outward from primary aiming point 50. Post portions 62 and 64 may be at least two times thicker than central portions 58 of primary horizontal and vertical sight lines 52 and 54, and more preferably three times thicker, to draw a shooter's eye to the thinner central portions 58 and thereby help the shooter to locate primary aiming mark or point 50. In some embodiments, innermost ends 66 of widened post portions 62 and 64 may serve as reference points for range estimation or windage compensation, as described in further detail below.

Reticle 40 includes one or more secondary aiming marks 68*a-c* spaced below primary aiming mark 50 along a vertical axis intersecting primary aiming mark 50. In the embodiment shown, the vertical axis is coincident with vertical sight line 54 and is, therefore, not separately shown or numbered. More preferably, reticles in accordance with certain preferred embodiments may include at least two such secondary aiming marks, spaced apart at distances from the primary aiming mark 50 preselected to compensate for bullet drop at incremental ranges to a target. In the embodiment of FIG. 4, three secondary aiming marks 68*a*, 68*b*, and 68*c* are formed by the intersection of secondary horizontal sight lines 72*a*, 72*b*, and 72*c* with primary vertical sight line 54. Alternatively, the secondary aiming marks need not be formed by intersecting horizontal and vertical lines, but may comprise other kinds of marks and indicia spaced apart below primary aiming mark 50. For example, in big game reticle 140 of FIG. 5, secondary aiming points 168*a* and 168*b* are indicated by the tips of opposing left and right CPC™-style secondary aiming marks 180*a* and 180*b*. Although each of the triangular CPC™-style secondary aiming marks 180*a* and 180*b* tapers to a sharp tip shown touching primary vertical sight line 154, in alternative embodiments (not shown), secondary aiming marks 180*a* and 180*b* need not touch primary vertical sight line 154 to indicate the location of secondary aiming points 168*a* and 168*b*. Thus, depending on the design preference, the secondary aiming marks may or may not overlap with, contact, or extend through the vertical axis or a primary vertical sight line to indicate the position on the vertical axis of the secondary aiming points 168*a* and 168*b*.

Turning again to FIG. 4, secondary aiming marks 68*a-c* are preferably arranged for accurate indication of bullet drop at incremental ranges when riflescope 10 is sighted-in at 200 yards—i.e., when the optical alignment of riflescope 10 relative to a barrel 44 of rifle 14 is adjusted so that primary aiming mark 50 accurately indicates a point of bullet impact 200 yards from the shooter. When riflescope 10 is sighted-in at 200 yards, secondary aiming marks 68*a*, 68*b*, and 68*c* will indicate points of impact at ranges of approximately 300, 400, and 500 yards, respectively, assuming the shot is not affected by crosswinds or lateral drift. Spacing of secondary aiming marks 68*a-c* for aiming at incremental ranges of round numbers makes it easy for a shooter to remember the ranges corresponding to the primary and secondary aiming marks 50 and 68*a-c*, and avoids the need to look away from the target to check a reference list of corresponding ranges, as with the riflescopes of U.S. Pat. Nos. 6,032,374 of Sammut and 6,591,537 of Smith. Moreover, in riflescopes according to the preferred embodiments, the optical power can be adjusted to compensate for different ammunition having different ballistics, as described below with reference to FIG. 7.

As indicated by dimension lines 74*a*, 74*b*, and 74*c*, the angles subtended between primary aiming point 50 and secondary aiming marks 68*a*, 68*b*, and 68*c* in the preferred embodiment are, respectively, 1.81 MOA, 4.13 MOA, and 7.02 MOA, at 16× magnification. When varmint reticle 40 is embodied in a transparent reticle disc located at rear focal plane 32 of riflescope 10, the actual physical dimensions of reticle lines and spacing between lines are determined based on the conversion factor of approximately 1.0 MOA=0.223 mm.

Similarly, secondary aiming marks 180*a-b* and 280*a-b* of respective second and third embodiment reticles 140 and 240 are spaced below primary aiming marks 150 and 250 for accurate indication of bullet drop at incremental ranges of 300 and 400 yards, when riflescope 10 is sighted-in at 200 yards. Because big game reticles 140 and 240 are designed to be used at a lower optical power and for a different type of ammunition than varmint reticle 40, the spacing between primary aiming mark 150/250 and secondary aiming points 168*a*/268*a* and 168*b*/268*b* is different from the corresponding spacing of secondary aiming marks 68*a-b* of varmint reticle 40. Preferably the 300-yard secondary aiming points 168*a* and 268*a* are spaced 2.19 MOA below the center of primary horizontal sight line 152/252 (i.e., primary aiming mark 150/252), at 10× magnification; and the 400-yard secondary aiming marks 168*b* and 268*b* are spaced 4.80 MOA from the center of primary horizontal sight line 152/252, at 10× magnification. Additional secondary aiming marks may be provided for compensating for bullet drop at longer ranges. For example, a 500-yard aiming mark 178/278 comprises the upper end of a lower post 164/264 in each embodiment, and a 450-yard aiming mark 176/276 comprises a short line intersecting primary vertical sight line 154/254. 450-yard aiming marks 176 and 276 are located 6.26 MOA below primary horizontal sight line 152/252 (measured center to center) and the 500-yard aiming marks 178 and 278 are located 7.82 MOA below the center of primary horizontal sight line 152/252, both measured at 10× magnification. When big game reticles 140 and 240 are embodied transparent reticle discs adapted to be located at rear focal plane 32 of riflescope 10, the actual physical dimensions of reticle markings and spacing therebetween on reticle discs are determined based on the conversion factor of approximately 1.0 MOA=0.139 mm.

Turning again to FIG. 4, varmint reticle 40 preferably includes a simple ranging device 76 for estimating the range to average-sized varmints and other targets that are approximately 7 inches in height. Ranging device 76 comprises a horizontal ranging line 78 positioned 2.333 MOA below the lowermost secondary aiming mark 68*c* at 16× magnification (a typical operating setting for varmint hunting), so that when a 7-inch-tall varmint 80 or another 7-inch target is located at 300 yards it will be closely bracketed in the gap 82 between secondary aiming mark 68*c* and ranging line 78. If a targeted varmint 80 is larger than gap 82, then it is closer than 300 yards and primary aiming mark 50 (or one of the associated windage aiming marks 86, described below) can be used for targeting. When a targeted varmint 80 is smaller than gap 82, the range is greater than 300 yards; thus, before selecting an aiming point, the shooter may want to use a precision ranging device such as a laser rangefinder, for example, to determine a more accurate range to the target.

A set of windage aiming marks 84 may be spaced apart along at least one secondary horizontal axis 88 intersecting a selected one of secondary aiming marks 68*a-c*, to facilitate compensation in aiming for the effect of crosswinds on the trajectory of the projectile. As with secondary aiming marks 68*a-c*, windage aiming marks 84 need not touch the corresponding secondary horizontal sight line 72*a-c* to indicate the location of windage aiming points on the secondary horizontal axis 88. However, in a preferred embodiment, windage aiming marks 84 include tick marks 92*a* and 92*b* intersecting or touching the ends of one or more of the secondary horizontal sight lines 72*a-c* and FLOATING SQUARE™ marks 94*a* and 94*b* for compensating for stronger crosswinds. First and second windage aiming marks 92*a* and 94*a* are spaced apart to the left of the vertical axis at distances from the vertical axis selected to compensate for leftward crosswinds of preselected first and second incremental velocities, respectively, at the incremental ranges of the corresponding secondary aiming mark. In the preferred embodiment, windage aiming marks 92*a* and 94*a* are positioned to compensate for first and second incremental crosswind velocities of 10 mph and 20 mph, respectively. Third and fourth windage aiming marks 92*b* and 94*b* are spaced apart to the right of the vertical axis at distances from the vertical axis selected to compensate for rightward crosswinds of preselected third and fourth incremental velocities, respectively, at the range of said selected secondary aiming mark. To simplify use of the reticle, the third and fourth windage aiming marks 92*b* and 94*b* are spaced to compensate for rightward crosswinds of third and fourth incremental velocities which are equal and opposite the respective first and second incremental velocities of the leftward crosswinds. Additional windage aiming marks 86 (also indicated as 92*a-b* and 94*a-b*) may be provided along primary horizontal sight line 52 for windage compensation at the sighted-in range (e.g., 200 yards) and the preselected crosswind velocities (e.g., 10 mph and 20 mph).

Figure 10:
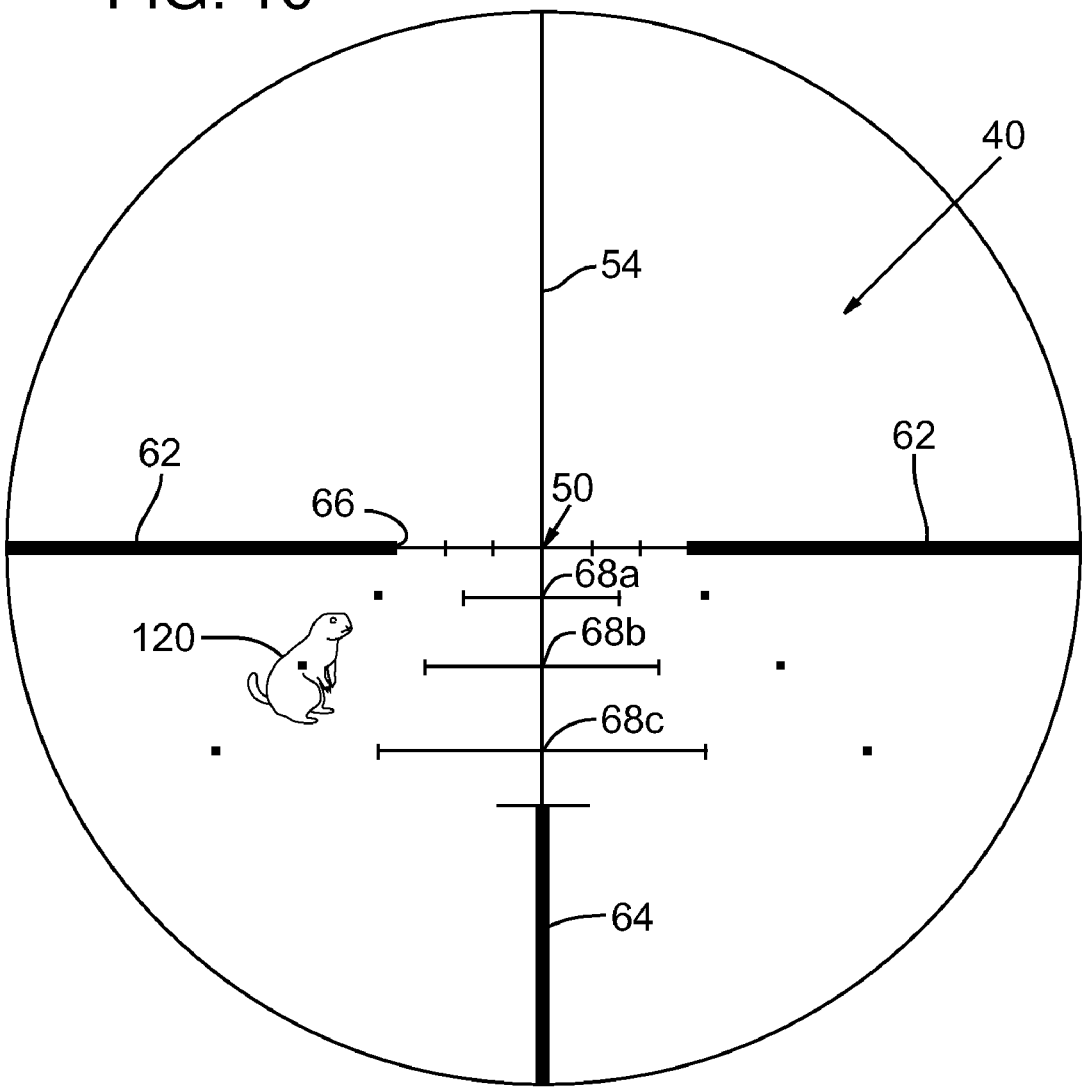
FIG. 10 is a view of the reticle of FIG. 3 shown aimed at a varmint at a known or estimated range of 400 yards and compensating for a known or estimated leftward (right-to-left) crosswind of 20 miles per hour.

FIG. 10 is a view of the reticle of FIG. 3 shown aimed at a varmint 120 (not to scale) at a known or estimated range of 400 yards and compensating for a known or estimated leftward (right-to-left) crosswind of 20 mph.

Table 1 sets forth the spacing of windage aiming marks 92*a*/92*b* and 94*a*/94*b* at the selected incremental ranges of primary and secondary aiming marks 50 and 68*a-c*:

TABLE 1

| Range/ corresponding sight line | Horizontal distance from vertical axis to 1st and 3rd windage aiming marks 92a/92b (10-mph crosswind) | Horizontal distance from vertical axis to 2nd and 4th windage aiming marks 94a/94b (20-mph crosswind) | Distance from aim point 50 to post ends 66 (30-mph crosswind) |
|---|---|---|---|
| 200 yds./line 62 | 1.77 MOA | 3.54 MOA | 5.31 MOA |
| 300 yds./line 72a | 2.86 MOA | 5.72 MOA | — |
| 400 yds./line 72b | 4.09 MOA | 8.17 MOA | — |
| 500 yds./line 72c | 5.49 MOA | 10.99 MOA | — |

Although the preferred embodiment of FIG. 4 shows a reticle 40 with four windage aiming marks 92*a*, 92*b*, 94*a*, and 94*b* at each range, greater or fewer than four windage aiming marks may also be used at each range. For example, as indicated in Table 1, at the sighted-in range of 200 yards, innermost ends 66 of post portions 62 may serve as a third pair of windage aiming marks, providing windage compensation for 30-mph crosswinds.

In the reticle 140 of FIG. 5, secondary aiming marks 180*a* and 180*b* are sized so that their outermost ends 192*a* and 192*b* are positioned to compensate for respective leftward and rightward 10-mph crosswinds. Marks 180*a*/180*b* at the 300-yard range (at secondary aim point 168*a*) are sized so that their ends 192*a* and 192*b* are located 2.16 MOA from the vertical axis. Marks 180*a*/180*b* at the 400-yard range (at secondary aiming point 168*b*) are sized so that at 10× magnification their ends are located 3.03 MOA from the vertical axis.

In the reticle 240 of FIG. 6, secondary aiming marks 280*a* and 280*b* are stepped to include radially outer post portions 284. Inner and outer ends 286 and 288 of post portions 284 are positioned to correct for crosswinds of 10 mph and 20 mph, respectively. At the 300-yard range (secondary aiming point 268*a*), inner ends 286 of post portions 284 are located 2.16 MOA from the vertical axis and outermost ends 288 are located 4.32 MOA from the vertical axis, both at 10× magnification. At the 400-yard range (secondary aiming point 268*b*), inner ends 286 of post portions 284 are located 3.03 MOA from the vertical axis and outer ends 288 are located 6.06 MOA from the vertical axis, both at 10× magnification.

The particular subtensions of secondary aiming marks 68, 168, and 268 are selected based on a survey of ballistic drop data for a variety of commonly used ammunition, which may be gathered empirically or calculated using the Ingalls Tables or ballistics software. FIG. 8 is a table including ballistics drop data for selected ammunition commonly used in big game hunting, for ranges of 300, 400, and 500 yards and based on a sighted-in distance of 200 yards. A nominal design for secondary aiming marks 168*a-b* and 178 was chosen to correspond to a 130 grain .270 caliber WINCHESTER (.270 WIN) bullet having a muzzle velocity of 3,000 feet per second (fps). The .270 WIN, 130 Gr., 3,000 fps was chosen as a nominal design because its ballistic characteristics are approximately median for a first group of ammunition 310 having ballistic characteristics within an acceptable error tolerance, at the selected incremental ranges. Based on ballistic calculations or empirical measurements at typical altitude, temperature and relative humidity, bullet drop for the .270 WIN, 130 Gr., 3,000 fps is determined to be approximately 6.88 inches at 300 yards. At a preselected nominal optical power of 10× magnification, 6.88 inches of ballistic drop converts to approximately 2.19 MOA below primary aiming point 50. Optical power of 10× magnification was preselected as the nominal optical power because it is commonly used for big game hunting. Subtensions for incremental ranges of 400 and 500 yards are selected in a similar manner, for the same nominal ammunition and 10× magnification.

One or more additional groups of ammunition having ballistic drop characteristics outside the acceptable error tolerance may also be selected. For example, ammunition of a second group 320 exhibits a greater amount of bullet drop than ammunition of first group 310. The present inventors recognized that to compensate for the different ballistic characteristics of ammunition of second group 320, the optical power of riflescope 10 could be decreased to thereby increase the subtensions of secondary aiming points 168*a-b* and 178. Thus, for example, an optical power of 7.5× magnification (a 25% decrease) is selected to provide a 25% increase in the subtension of secondary aiming mark 168*a*, to approximately 2.74 MOA (2.19 MOA×1.25=2.74 MOA), thereby corresponding to an approximate median ballistic drop of second group 320.

In the preferred embodiment, the ammunition is grouped into only two groups 310 and 320 for simplicity and ease of use. However, for more precise aiming, the same ammunition shown in FIG. 8 could be grouped into a greater number of groups, in which case ammunition other than .270 WIN might be selected as the nominal design. A group of ammunition may include as few as one particular kind of ammunition. The particular ammunition listed in FIG. 8 is merely exemplary. For the exemplary ammunition and based on the above-described grouping and optical magnification, FIG. 8 lists, at each of the incremental ranges of 300, 400, and 500 yards, the inches of error from the nominal design, the corresponding MOA at the preselected optical power, the deviation from nominal (in percent), and the corresponding approximate best optical power. This data, and especially approximate best optical power, is used to group the ammunition.

In yet other embodiments, different ammunition may be utilized at the settings corresponding to one of the groups, but at different incremental ranges. For example, .300 Ultra Mag (UM) ammunition 330 was determined to have ballistic drop characteristics that fall outside of the acceptable tolerance ranges for both of the first and second groups 310 and 320 of ammunition (i.e., more than 2.0 inches of deviation from nominal at 300 yards and nearly 11.5 inches of deviation from nominal at 500 yards). However, for the same .300 UM ammunition, if riflescope 10 is sighted-in at 300 yards instead of 200 yards (as indicated in FIG. 8 at 340), then secondary aim points 168*a*, 168*b*, and 178 can be used effectively to compensate for ballistic drop at 400, 500, and 600 yards, respectively, with an acceptable margin of error.

Figure 7:
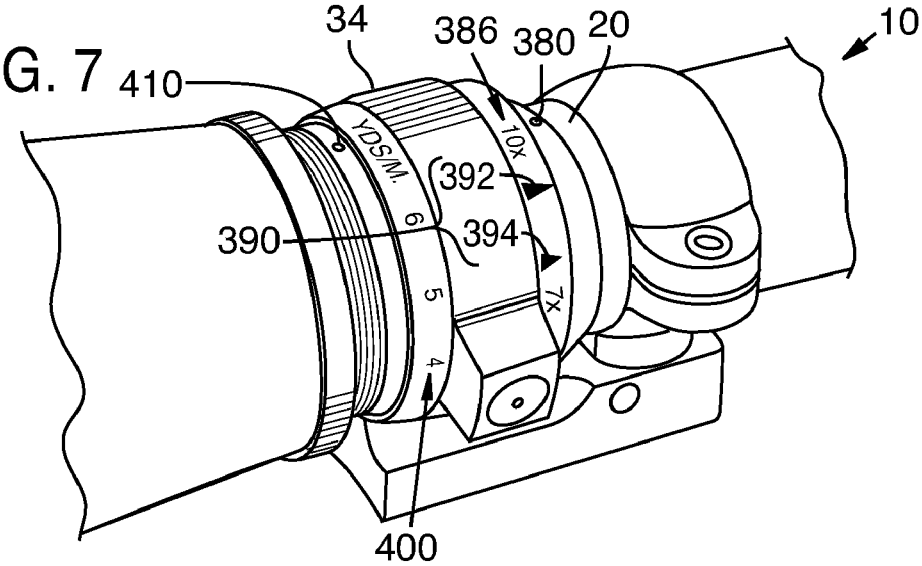
FIG. 7 is an enlarged top view of the riflescope of FIG. 1, showing detail of a power selector mechanism and associated fiducials used for varying the optical power setting of the riflescope to compensate for ballistic differences between two groups of ammunition; and further showing associated ranging fiducials used, in cooperation with ranging features of the reticle and the power selector mechanism, to estimate the range to a target of known or estimable size.

To facilitate adjustment of the subtensions of the secondary aiming marks for different groups of ammunition, a set of fiducial marks can be associated with power selector ring 34 to indicate the prescribed optical power settings for the different groups. FIG. 7 is a an enlarged partial pictorial view of the eyepiece end of riflescope 10 showing detail of power selector ring 34 and a portion of the right side housing 20. A dot 380 or other mark on housing 20 is used in cooperation with optical power indicia 386 on power selector ring 34 to indicate the optical power setting of riflescope 10. A set of fiducial marks 390 is also provided and includes, in the preferred embodiment, first and second fiducials 392 and 394 corresponding to the first and second groups of ammunition 310 and 320 listed in FIG. 8. In preparation for using riflescope 10, the shooter selects one of the fiducial marks 390 corresponding to the group of ammunition including the caliber of rifle 14 and type of ammunition to be used, and then rotates power selector ring 34 until the selected fiducial mark is aligned with dot 380. The relative large and small sizes of fiducials 392 and 394 are generally suggestive of the relative muzzle velocities and masses of the groups of ammunition, to help remind the shooter of the ammunition to which fiducials 390 correspond. Many other configurations and arrangements of power selector mechanism and fiducials may be used in place of the embodiment shown.

Figure 9:
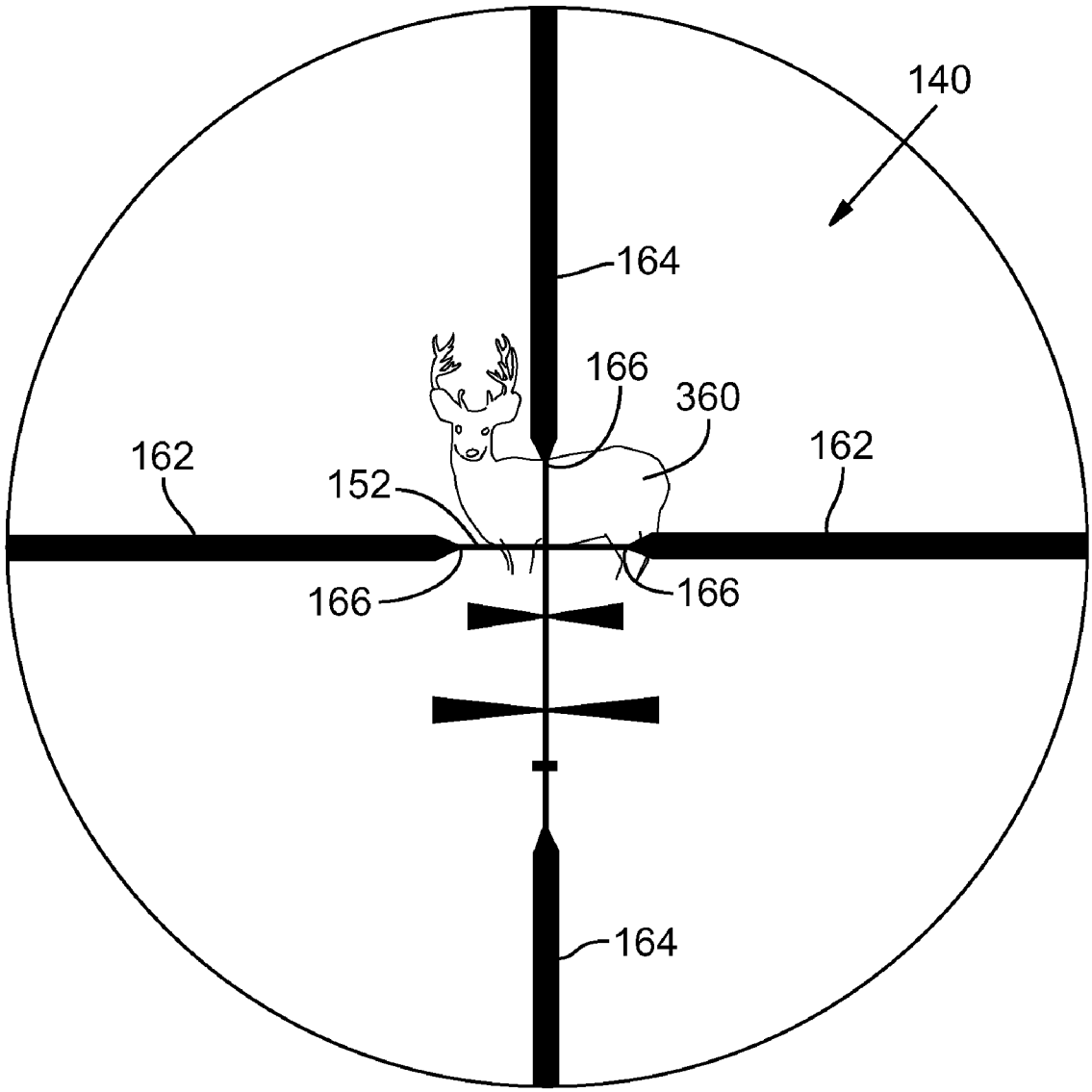
FIG. 9 is a view of the reticle of FIG. 5 showing range-estimating features of the reticle being used to determine an estimated range to a game animal of known or estimated size.

Riflescope 10 and reticles 40, 140, and 240 may also include a built-in range estimator. FIG. 9 is an auxiliary view of reticle 140 of FIG. 5 being used for range estimation. With reference to FIG. 9, the range estimator utilizes a known spacing between the ends 166 of post portions 162 and 164 (also called the "pickets") and the central primary aiming mark 150 at a known magnification to estimate the range to targets of a known or estimated size. For example, ends 166 are spaced between approximately 7 MOA and 8 MOA from primary aiming mark 150 at the lowest optical power setting of riflescope 10 and more preferably approximately 7.6 MOA, which corresponds to approximately 16 inches at 200 yards. At the highest optical power—three times the lowest power for a zoom ratio of 3:1—the spacing between ends 166 and primary aiming mark 150 corresponds to a 16-inch target at 600 yards. To estimate range, a hunter frames the back-to-brisket feature of a deer 360 (which is known to be approximately 16 inches in height) between primary horizontal sight line 152 and end 166 of vertical picket 164, rotating power selector ring 34 to adjust the optical power, as necessary. When the optical power is adjusted so as to closely frame the back-to-brisket feature of deer 360, the hunter then views a set of ranging fiducials 400 (FIG. 7) associated with power selector ring 34 to determine the range to target. In the preferred embodiment, ranging fiducials 400 shown as "4", "5", and "6" indicate ranges of 400, 500, and 600 yards, respectively. (Ranging fiducials "2" and "3" corresponding to 200 and 300 yards are obscured in FIG. 7.) By determining which of the ranging fiducials 400 is most closely aligned with a ranging dot 410 on housing 20, the hunter can then quickly determine (estimate) the range to target.

Projectile weapon aiming systems have been described herein principally with reference to their use with rifles and embodied as riflescopes. However, skilled persons will understand that projectile weapon aiming systems may include aiming devices other than riflescopes, and may be used on weapons other than rifles, which are capable of propelling projectiles along substantially predeterminable trajectories, e.g., handguns, crossbows, and artillery. Thus, it will be obvious to those having skill in the art that many changes may be made to the details of the above-described embodiments without departing from the underlying principles of the invention. The scope of the present invention should, therefore, be determined only by the following claims.

The invention claimed is:

1. A method for aiming a projectile weapon that shoots a selected projectile having associated ballistic characteristics, comprising:

based on at least the selected projectile, identifying a corresponding projectile group from at least two different predetermined groups of projectiles, each group encompassing two or more different types of projectiles having different calibers, each group having associated nominal ballistic characteristics;

sighting-in the projectile weapon at a predetermined first range so that a primary aiming point of an aiming device associated with the projectile weapon is superposed with a nominal point of impact of a projectile when shot from the projectile weapon at the first range;

after sighting-in the projectile weapon, determining a range to a target;

based on the range to the target and the nominal ballistic characteristics of the identified projectile group corresponding to the selected projectile, determining an aiming adjustment for the projectile weapon; and using the aiming device, aiming the projectile weapon based on the aiming adjustment.

2. The method of claim 1, further comprising adjusting a reticle display of the aiming device based on the identified projectile group.

3. The method of claim 1, wherein the selected projectile is a type of ammunition.

4. The method of claim 1, wherein the selected projectile is an arrow.

5. The method of claim 1, wherein the predetermined groups of projectiles are mutually exclusive.

6. The method of claim 1, further comprising adjusting a setting of the aiming device based on the identified projectile group.

7. The method of claim 6, wherein adjusting a setting of the aiming device includes adjusting an optical power setting.

8. The method of claim 1, further comprising displaying the aiming adjustment including displaying a reticle in a riflescope, the reticle including the primary aiming point and a secondary aiming mark spaced below the primary aiming point.

9. The method of claim 1, wherein the aiming adjustment includes a holdover adjustment.

10. A method for aiming a projectile weapon that shoots a selected projectile having associated ballistic characteristics, comprising:

obtaining a list of multiple types of projectiles and associated predetermined projectile groups, wherein each predetermined projectile group encompasses two or more of the types of projectiles on the list having similar ballistic characteristics including at least two such types of projectiles having different calibers, each projectile group corresponding to one of several predetermined ballistic compensation settings;

from the list, identifying one of the ballistic compensation settings corresponding to the selected projectile;

determining a range to a target;

based on the range to the target and the identified one of the ballistic compensation settings, determining an aiming adjustment for the projectile weapon; and aiming the projectile weapon based on the aiming adjustment.

11. The method of claim 10, wherein each of the ballistic compensation settings is indicative of an optical power setting of an aiming device.

12. The method of claim 10, wherein the selected projectile is a type of ammunition.

13. The method of claim 12, wherein the predetermined projectile groups include at least two mutually exclusive types of cartridges.

14. The method of claim 12, wherein each predetermined projectile group includes at least two mutually exclusive types of ammunition.

15. The method of claim 10, further comprising adjusting a setting of an aiming device based on the identified one of the ballistic compensation settings.

16. The method of claim 15, wherein adjusting a setting of an aiming device includes adjusting an optical power setting.

17. The method of claim 10, further comprising displaying the aiming adjustment including displaying a reticle in a riflescope, the reticle including a secondary aiming mark spaced below a primary aiming point.

18. The method of claim 10, wherein the aiming adjustment includes a holdover adjustment.

19. The method of claim 10, wherein the predetermined projectile groups include at least a predetermined first group and a predetermined second group, the first and second groups having different nominal ballistic characteristics, the ballistic characteristics of the types of projectiles associated with the first group falling within a first acceptable error tolerance from the nominal ballistic characteristic of the first group, and the ballistic characteristics of the types of projectiles associated with the second group falling within a second acceptable error tolerance from the nominal ballistic characteristic of the second group.

20. A method for aiming a projectile weapon that shoots a selected projectile having associated ballistic characteristics, comprising:

based on at least the selected projectile, identifying one predetermined projectile group from two or more predetermined projectile groups, wherein each predetermined projectile group includes two or more different projectiles having different calibers and a projectile having ballistic characteristics that are approximately median for said projectile group, and wherein the ballistic characteristics that are approximately median are different for each predetermined projectile group;

determining a range to a target;

based on the range to the target and the identified projectile group, determining an aiming adjustment for the projectile weapon; and aiming the projectile weapon based on the aiming adjustment.

21. The method of claim 20, wherein:

the selected projectile is a type of ammunition; and the two or more different projectiles includes at least two mutually exclusive types of ammunition.

22. The method of claim 20, further comprising adjusting a reticle display of an aiming device associated with the projectile weapon based on the identified projectile group.

23. The method of claim 20, wherein the selected projectile is a type of ammunition.

24. The method of claim 20, wherein the predetermined groups of projectiles are mutually exclusive.

25. The method of claim 20, further comprising adjusting a setting of an aiming device based on the identified projectile group.

26. The method of claim 25, wherein adjusting a setting of an aiming device includes adjusting an optical power setting.

27. The method of claim 20, further comprising displaying the aiming adjustment including displaying a reticle in a riflescope, the reticle including a secondary aiming mark spaced below a primary aiming point.

28. The method of claim 20, wherein the aiming adjustment includes a holdover adjustment.

29. The method of claim 20, wherein the predetermined groups of projectiles include at least a predetermined first group and a predetermined second group, the first and second groups having different nominal ballistic characteristics, the ballistic characteristics of the types of projectiles associated with the first group falling within a first acceptable error tolerance from the nominal ballistic characteristic of the first group, and the ballistic characteristics of the types of projectiles associated with the second group falling within a second acceptable error tolerance from the nominal ballistic characteristic of the second group.

30. The method of claim 1, wherein the predetermined groups of projectiles include at least a predetermined first group and a predetermined second group, the first and second groups having different nominal ballistic characteristics, the ballistic characteristics of the types of projectiles associated with the first group falling within a first acceptable error tolerance from the nominal ballistic characteristic of the first group, and the ballistic characteristics of the types of projectiles associated with the second group falling within a second acceptable error tolerance from the nominal ballistic characteristic of the second group.

* * * * *